US008604375B2

(12) United States Patent
Yltchev et al.

(10) Patent No.: US 8,604,375 B2
(45) Date of Patent: Dec. 10, 2013

(54) DEVICE WITH AT LEAST ONE CONTROL ELEMENT

(75) Inventors: Georgy Yltchev, Gundelfingen (DE); Thomas Schulz, Waldkirch (DE); Christian Doebele, Freiburg (DE)

(73) Assignee: Sick AG, Waldkirch (DE)

( * ) Notice: Subject to any disclaimer, the term of this patent is extended or adjusted under 35 U.S.C. 154(b) by 277 days.

(21) Appl. No.: 12/654,975

(22) Filed: Jan. 11, 2010

(65) Prior Publication Data

US 2010/0175975 A1 Jul. 15, 2010

(30) Foreign Application Priority Data

Jan. 14, 2009 (DE) ..... 10 2009 004 975

(51) Int. Cl.
*H01H 13/85* (2006.01)

(52) U.S. Cl.
USPC ..... 200/406

(58) Field of Classification Search
USPC ..... 200/406, 402, 513, 516
See application file for complete search history.

(56) References Cited

U.S. PATENT DOCUMENTS

| | | | | |
|---|---|---|---|---|
| 6,596,954 | B2 * | 7/2003 | Miyashita | 200/406 |
| 7,378,609 | B1 * | 5/2008 | Fedorjaka | 200/516 |
| 7,557,320 | B1 * | 7/2009 | Crooijmans et al. | 200/406 |
| 2008/0164133 | A1 | 7/2008 | Hayafune | |

FOREIGN PATENT DOCUMENTS

| | | | |
|---|---|---|---|
| DE | 41 39 554 | A1 | 4/1993 |
| DE | 10 2004 004 136 | B4 | 8/2005 |
| DE | 10 2006 010 811 | A1 | 9/2007 |
| EP | 1 589 552 | A1 | 10/2005 |
| GB | 221504 | A | 5/1925 |

* cited by examiner

*Primary Examiner* — Felix O Figueroa
(74) *Attorney, Agent, or Firm* — Nath, Goldberg & Meyer; Jerald L. Meyer; SanJana Mangalagiri

(57) ABSTRACT

A device is provided with at least one control element that can be used to trigger a switching process for electrical or mechanical installations. The control element is positioned in a device housing for the device, such that the control element is designed as a snap disk, which is made of metal, and such that the snap disk has a rim which is connected to the device housing through material engagement and which forms a seal between the device housing and the control element, such that an area of the snap disk that borders the rim is designed as a reversibly deformable uncoupling area.

17 Claims, 2 Drawing Sheets

DEVICE WITH AT LEAST ONE CONTROL ELEMENT

BACKGROUND

The prior art is acquainted with control elements that can be manually operated and that are used to trigger a switching process for electrical or mechanical installations.

Known here in particular are control elements that take the form of a snap disk, where a snap disk is understood as element with discontinuous transition characteristics such that, when the control element is actuated, the application of an actuating force by the snap disk generates a switching stroke and a snapping motion is executed. In particular, this snapping reversal is perceived by the user haptically, or by touch, and the user can thereby recognize that the switching event has been successfully triggered.

In industrial applications, control elements in the form of switches and sensors are increasingly subject to new requirements with respect to resistance to external influences, particularly influences of a mechanical, chemical, or weather-specific nature.

The mechanical influences take the form of potential damage caused by foreign objects, which are in a position to scratch, abrade, or penetrate surfaces, and therefore to cause mechanical failure of the control element. When devices are used in many areas of industry, for example, the food, solar energy, and pharmaceutical industries, devices must fulfill the requirements of sealing class IP69k, which specifically demands that the devices withstand in undamaged condition cleansing with a jet of pressurized water, with a pressure in the range from 80 to 100 bar, and a water temperature of 80° C., where the jet spacing is from 100 to 150 mm. This means that high demands are placed on the stability and robustness of the control element and the device, as well as on the seal between the control element and the device.

Chemical influences caused by aggressive media used in the industrial field—for example, the food industry—to purify production lines and their environment also place high demands on the material to be used, since aggressive cleaning media are able to bite into the surface of devices and to cause corrosion, and thus to damage the devices and jeopardize their long-term reliability.

Included among weather-determined instances of damage to a control system are, for example, the missing or insufficient resistance of the employed materials with respect to ultraviolet radiation and ozone. A further problem area is posed by the tightness, temperature resistance, and resistance to change in temperature that are demanded of the control elements.

In addition to the material-technical requirements for the control element, the demand for a haptic perception of the switching event is of primary importance in providing a user-friendly control element. Upon actuation of a scanner this is defined by a tactile snapping movement, which is perceptible during the operation.

For example, DE 10 2004 004 136 B4 discloses a small electrical device with a snap disk made of plastic. DE 41 39554 A1 discloses a snap disk of sheet metal for use as a contact element for a switch, with an additional protective layer of plastic. Snap disks of metal are disadvantageous, however, in that they require a degree of freedom on the outer rim in order to permit the center of the snap disk to move. Metal snap disks therefore rest only on a wall or in a recess. If disks of this kind are firmly clamped, the snap disk stiffens into an inflexible structure, which can only be reformed through deformation. To permit a seal of the metal snap disks relative to the housing, additional sealing elements are required, like those known, for example, from DE 10 2006 010 811 A1.

SUMMARY

It is desired to provide a simply designed, robust mechanical control element for a device.

The device according to one configuration has at least one control element, which is positioned in a device housing, such that the control element takes the form of a snap disk produced from metal, and is characterized by the fact that the snap disk has a rim which is joined to the device housing by material engagement and forms a seal between the device housing and the control element, such that a portion of the snap disk bordering on the rim is designed as a reversibly deformable or malleable uncoupling area. The material engagement of the rim of the snap disk with the device housing is formed by a seal between the device housing and the control element, which is also able to specifically fulfill the high demands set by tightness class IP69k. The reversibly deformable uncoupling area between the actual area of the snap disk and the rim of the snap disk ensures that the disk does not stiffen into an inflexible structure, however. The result is that the degree of comfort during actuation, as known in conventional snap disks, is retained. Moreover, when an actuating force is exerted, the control element according to one configuration is moved from a stable condition into a meta-stable condition, in which an electrical switching element lying below the snap disk is actuated by the stroke of the control element. The inner sections of the control element are elastically deformed in this state. Furthermore, the uncoupling area is also reversible deformed. When the actuating force is removed, the snap disk snaps back into its original position, due to the flexibility of the inner contour that is permitted by the uncoupling area. The uncoupling area thus makes available the needed degree of freedom, which is required by the actual snapping of the inner area of the snap disk.

BRIEF DESCRIPTION OF THE DRAWINGS

The disclosed subject matter will next be described in greater detail on the basis of the following figures. Shown are.

DETAILED DESCRIPTION

Overview

Figure 1B:
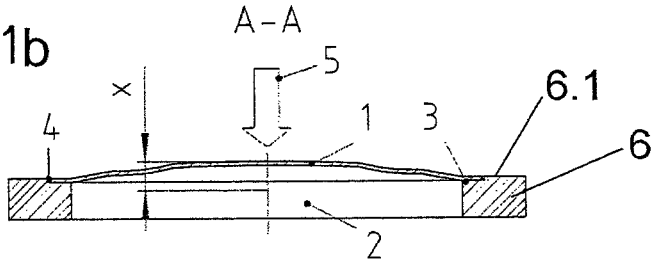
FIG. 1*b* a section along line 1*b*-1*b* in FIG. 1*a*.

The uncoupling area is advantageously designed as a diagonally positioned area which, in particular, allows the uncoupling area to be produced in a simple manner.

The uncoupling area is advantageously designed in a circular, concentric manner, to permit a simple design of the control element.

In one example configuration, the snap disk is round in shape and the uncoupling area is designed as a conical area. As an alternative, the snap disks can have a rectangular design, particularly a square one; or they can be polygonal or oval.

In an extreme case, a preferred embodiment also provides for the coupling area to have a cylindrical design.

In one example, the snap disk has a diameter and a switching path such that the ratio of the diameter to the switching path is about 20:1. This results in low actuating forces.

In one configuration, the snap disk has a convex cap (looking onto the outside of the device housing) and a concave shoulder, which is concentrically positioned relative to the convex cap. The uncoupling area rests concentrically against this shoulder. This permits the snap disk to have a shape that is free of indentations or depressions, which in turn ensures that liquid cannot collect on the surface of the snap disk. For this reason, to the incline of the uncoupling area, in such a way that the uncoupling area rises in the outward direction, proceeding from the rim of the snap disk.

According to one example, the snap disk is connected to the device housing to a form a single piece, so that there are no gaps or joints on the outside of the device and the device can thus be easily cleaned and can satisfy the high hygienic standards that apply for its use in the food industry.

In an alternative example, the snap disk is connected to the device housing by welding or adhesion, which, in a simple manner, makes possible a tight seal between the snap disk and the device housing.

In an alternative example, the snap disk is stamped into a metal strip, which is connected to the device housing. This easily produces a surface that is free of gaps. In particular, a plurality of control elements—including, for example, a keyboard—can be produced in a particularly simple way and positioned on the device housing.

The device housing can be advantageously manufactured from metal or plastic, and here the material used for the device housing will advantageously fulfill the requirements set by tightness class IP69k and/or be chemically resistant to the aggressive cleansing media typically used in the food industry, the solar energy industry, or the pharmaceutical industry.

The device can be advantageously designed as a measuring or control device, particularly an electrical or electronic sensor, particularly an optoelectronic sensor, particularly a light barrier or light curtain. The device can be advantageously designed for use in a moist environment. It is particularly preferred if the device is employed in industries relating to food, nutrition, luxury foods, and or beverages; in the solar energy industry and the pharmaceutical industry; and those where the device can be cleaned with chemicals, particularly aggressive chemicals. It is particularly preferred if the device satisfies the demand of tightness class IP69k. The use of a metal snap disk—which is connected in circular fashion to the device housing through material engagement and forms a seal between the device housing and the control element—specifically allows the device to be used in the indicated industries and fulfills the requirements of tightness class IP69k. Here the employment of a snap disk provides the user with a user-friendly control element.

Control Element

Figure 1A:
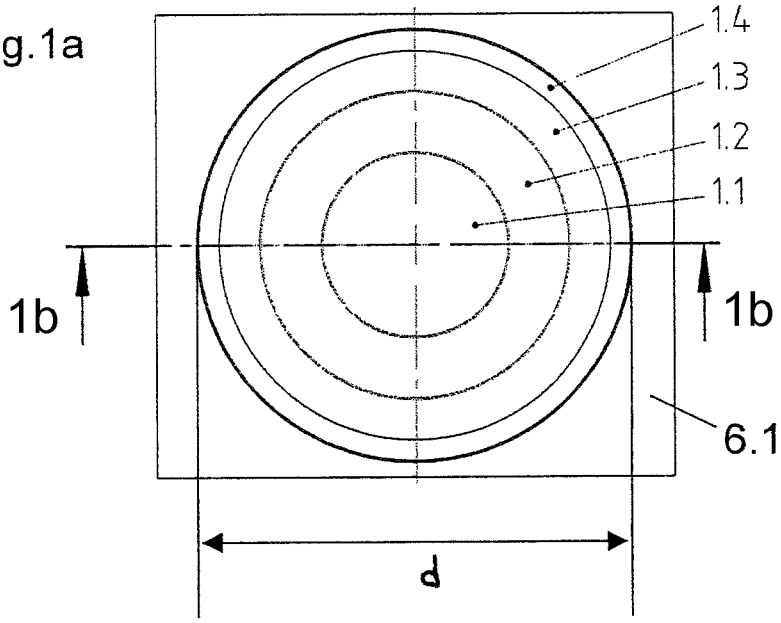
FIG. 1*a* a top view of a segment of a device housing with one control element.

FIGS. 1*a* and 1*b* give different views of a section of the device housing 6, which has a control element according to an initial example. FIG. 1*a* provides a top view of a part of the device housing 6 in which a hole 2 is placed (compare FIG. 1*b*). The device housing 6 here may be produced of plastic or metal.

The hole 2 is covered by a control element designed as a snap disk 1, such that the hole 2 has a larger diameter on the outside 6.1 of the device housing 6, so as to form a circular supporting rim for the snap disk 1. The circular supporting rim lies on a reception plane 3. Between the reception plane 3 and the outside 6.1 of the device housing 6, the area of the hole 2 with the larger diameter has a height such that the snap disk 1 closes firmly against the outside 6.1 of the device housing 6. The snap disk is connected to the device housing 6 in a circular fashion and engages materially with the latter, e.g., through welding or gluing. A welding or adhesion seam 4 is created in the process. The snap disk 1 is made of metal.

The snap disk 1 is round in shape, but may also be oval, rectangular, square, or polygonal.

With its rim 1.4 the snap disk 1 rests in particular on the supporting edge of the hole 3 and is connected by the rim 1.4 to the device housing 6 through material engagement, with the result that a seal is created between the device housing 6 and the snap disk 1.

Adjoining the rim 1.4—which in the present exemplary embodiment extends in the radial direction across a portion of the diameter of the snap disk 1, in order to permit a defined, flat support surface for a reliable and reproducible connection with the device housing 6—is an uncoupling area 1.3, which is designed as a diagonally positioned surface. In the present case, a conical area arises due to the round design of the snap disk. Proceeding from the reception plane 3, the uncoupling area 1.3 rises in the outward direction, specifically proceeding from the reception plane 3 in the direction of the outside 6.1 of the device housing. The incline of the diagonally positioned area, or the conical area, is variable, and in the extreme case the uncoupling area 1.3 can also be designed as a cylindrical area. Adjoining the uncoupling area 1.3 is a flexible inner area, which has a convex cap 1.1 (seen from a view looking on to the exterior of the device housing 6.1), and a concave shoulder, which is concentrically positioned around the convex cap 1.1. The cap 1.1 and the convex shoulder 1.2 form the actual area of the snap disk 1. The uncoupling area 1.3 is concentrically circular in design; specifically, it is concentrically circular around the concave shoulder 1.2. The concave shoulder 1.2 is designed in such a way that—in the direction of the actuating force—the deepest point of the concave shoulder 1.2 adjoins the uncoupling area 1.3, to thereby avoid creating depressions in the snap disk, in which liquid could collect on the snap disk 1.

When an actuating force is applied to the outside of the snap disk 1, the convex cap 1.1 snaps into a plane or slightly concave structure and the concave section 1.2 snaps into a convex structure. The uncoupling area 1.3 is reversibly flexible or deformable and thereby permits the inner area to snap and convert its shape despite the snap disk's rim 1.4, which is circularly form-fitting with the device housing 6.

With the actuating force 5, a switching path x is realized in the snap disk 1, by means of which a switching element (not depicted), which is positioned inside the device housing 6 and beneath the snap disk 1, can be actuated. The snap disk 1 has a diameter d, such that the ratio of diameter d to switching path x is about 20:1, to thereby realize slight actuating forces, particularly actuating forces in the range from 6 to 12 newtons. When the actuating force has been removed, the caps 1.1, 1.2 and the uncoupling area 1.3 return to their original positions.

To set a defined switching path x and to improve the stability of the system, and particularly to prevent the plastic deformation of the snap disk 1 by excessive actuating forces, an arresting structure—which has, e.g., only an aperture in the area of the cap 1.1—can be provided in the device housing 6 inside of the hole 2.

Figure 2B:
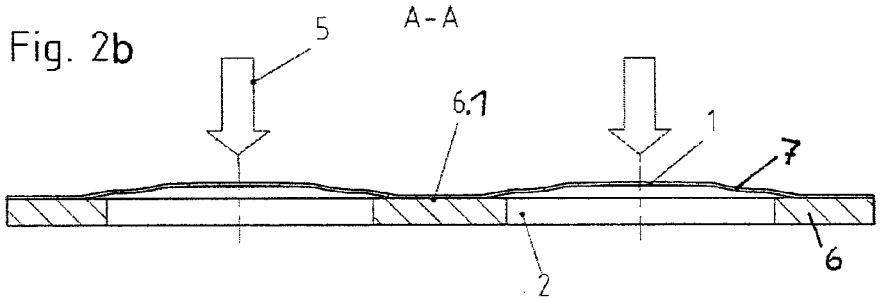
FIG. 2*b* a section along line 2*b*-2*b* of FIG. 2*a*.
Figure 2A:
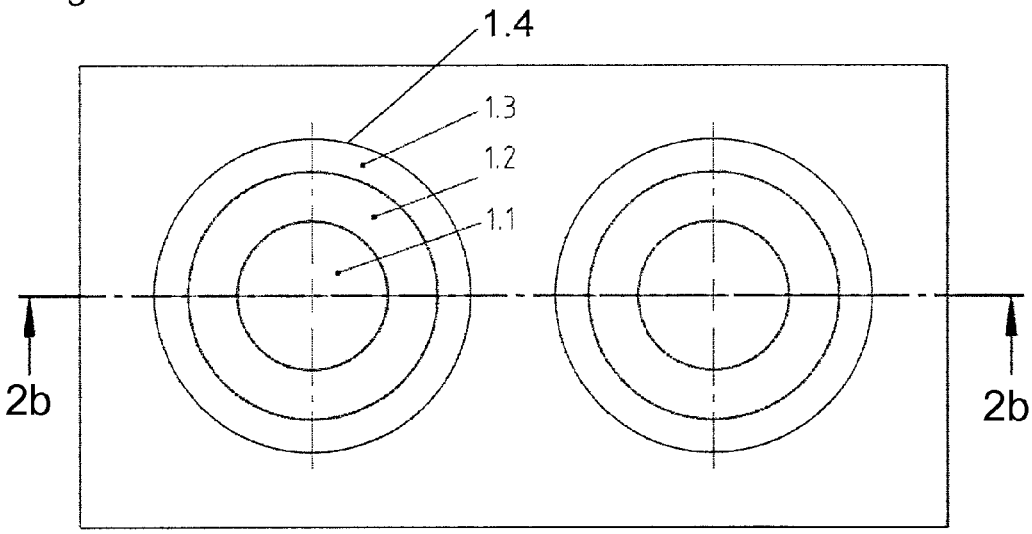
FIG. 2*a* a top view of a segment of a device housing with two control elements.

FIGS. 2*a* and 2*b* show an alternative exemplary embodiment. Here identical reference numerals designate the same parts as in the exemplary embodiment of FIGS. 1*a* and 1*b*. In the second embodiment of FIGS. 2*a* and 2*b*, not one, but two snap disks 1 are positioned in the device housing. Naturally a plurality of snap disks 1 according to the exemplary embodiment of FIGS. 1*a* and 1*b* can also be positioned in a device housing 6—or only one snap disk according to the exemplary embodiment of FIGS. 2*a* and 2*b* in a device housing 6. In particular, a keyboard can be realized with an arrangement of several snap disks 1. For example, two control elements can be used in optoelectronic sensors to provide to an adjustment function for the range of coverage.

The second exemplary embodiment basically differs from the first exemplary embodiment according to FIGS. 1*a* and 1*b* in that the snap disks 1 are stamped in a metal strip 7, which is positioned on the outside 6.1 of the device housing 6. The actual geometry of the cap 1.1, the shoulder 1.2 of the snap disk 1, and the uncoupling area 1.3 corresponds to the snap disk 1 of the exemplary embodiment shown in FIGS. 1*a* and 1*b*. As a result, the snap disks 1 do not have to be individually secured in the device housing 6. Instead, the entire metal strip 7 is simply attached to the outside 6.1 of the device housing 6. This ensures a gap-free surface. Furthermore, it becomes simple to position a plurality of control elements on the device housing 6, e.g., a keyboard. The metal strip 7 covers the holes 2 of the device housing 6 and in particular forms a seal between the device housing 6 and the snap disks 1. The seal is formed specifically with the area of the metal strip 7 that is positioned outside the uncoupling area 1.3 of the snap disks 1- or only with the rim of the metal strip 7. Both the area of the metal strip 7 that is positioned outside the uncoupling area 1.3, and the rim of the metal strip 7 represent a rim 1.4 of the snap disk 1, and this rim 1.4 is connected to the device housing 6 through material engagement.

In an exemplary embodiment that is not depicted, snap disks which are made of metal are connected to the device housing to form a single piece. Here the device housing is made of metal. A support rim within the hole in the device housing is therefore unnecessary. It is also possible to omit a rim area which extends in the radial direction and makes possible a defined rest for the snap disk—since the snap disk is connected by the rim to form a single piece with the device housing. A single-piece connection between the snap disk 1 and the device housing permits a surface that is free of gaps and of welding seams. The actual geometry of the cap, the shoulder of the snap disk, and the uncoupling area corresponds to the snap disk 1 of the exemplary embodiment show in FIGS. 1*a* and 1*b*.

The control element may be used in the device housings of the most varied devices—for example, measuring devices and control devices, particularly electrical or electronic sensors, particularly optoelectronic sensors, particularly light barriers or light curtains. The placement of the snap disks 1 in the device housing in accordance with both described exemplary embodiments permits the use of the device with the given control element in a moist environment, particularly in branches of industry with high demands with respect to tightness, temperature resistance, resistance to change in temperature, mechanical abrasion resistance, print-through resistance to external mechanical effects, steam and gas permeability, low moisture absorption, and/or with hygienic requirements, particularly in industries relating to food, nutrition, luxury foods, and or beverages, and in the solar energy industry and the pharmaceutical industry, in which, in particular, the employed devices are cleaned with chemicals, particularly aggressive chemicals, since through use of a snap disk the described exemplary embodiments permit a robust design for the control element, while simultaneously affording a good seal between the control element and the device housing. In particular, the use of the described control element permits the fulfillment of the requirements of sealing class IP69k. Furthermore, the snap disks provide a highly user-friendly control element, which allow the user to feel manually whether the switching event has been successfully triggered.

List of Reference Numerals

1. snap disk
1.1 cap
1.2 shoulder
1.3 uncoupling area
1.4 rim
2 hole
3 reception plane
4 welding seam/adhesion seam
5 actuating force
6 device housing
6.1 exterior
7 metal strip
d diameter
x switching path

The invention claimed is:

1. Device with at least one control element, the control element is designed as a snap disk which is made of metal, comprising:
a housing made of metal; and
a rim portion of the snap disk welded to the housing, forming a seal between the housing and the snap disk such that an area of the snap disk that borders the rim forms a reversibly deformable uncoupling area.

2. Device according to claim 1, wherein
the uncoupling area is a diagonally positioned surface.

3. Device according to claim 1, wherein
the uncoupling area has a circular, concentric configuration.

4. Device according to claim 1, wherein
the snap disk is round in shape and the uncoupling area is a conical surface.

5. Device according to claim 1, wherein
the uncoupling area has a cylindrical configuration.

6. Device according to claim 1, wherein
the snap disk has a diameter (d) and a switching path (x), such that a ratio of the diameter to the switching path is about 20:1.

7. Device according to claim 1 wherein
the snap disk has a convex cap and a concave shoulder concentrically positioned around the convex cap and concentrically bordered by the uncoupling area.

8. Device according to claim 1, wherein
the snap disk forms a single piece with the housing.

9. Device according to claim 1, wherein
the snap disk comprises a stamped metal strip, welded to the housing.

10. Device according to claim 1, wherein
the device is designed as a measuring or control device.

11. Device according to claim 1, wherein
the device is designed as an optoelectronic sensor.

12. Device according to claim 1 wherein
the device is designed for use in a moist environment.

13. Device according to claim 1, wherein
the device is designed for use in industries relating to food, nutrition, luxury foods, and or beverages, and in solar energy and pharmaceutical industries.

14. Device according to claim 1, wherein
the device can be cleaned with aggressive chemicals.

15. Device according to claim 1, wherein
the device is designed as an electric or electronic sensor providing a function as a measuring or control device.

16. Device according to claim 1, wherein the device is designed as an optoelectronic sensor in the form of a light barrier or a light grid.

17. A device with at least one control element, the device comprising:

a device housing made of metal, the device housing comprising: a hole and a circular supporting rim having a larger diameter than the hole, the circular supporting rim forming a reception plane;

a snap disk made of metal, the snap disk comprising: a rim portion, an uncoupling area, a concave shoulder, and a convex cap arranged concentrically, the snap disk being positioned on the receiving plane of the device housing and the rim portion of the snap disk being welded the to the device housing, forming a seal between the device housing and the snap disk; and an electrical switching element positioned inside the device housing and below the snap disk, whereby an actuating force exerted on the snap disk moves the snap disk from a stable condition to a meta-stable condition and actuates the switching element below the snap disk, the convex cap becoming concave and the concave shoulder becoming convex in the meta-stable condition, and wherein the snap disk snaps back to the stable condition upon removal of the actuating force.

* * * * *